US006097912A

United States Patent [19]

Watson et al.

[11] Patent Number: 6,097,912

[45] Date of Patent: Aug. 1, 2000

[54] PROTECTIVE COVER PACKAGE FOR AN ORGANIC PHOTORECEPTOR BELT

[75] Inventors: John D. Watson, Centerville; Henry C. Gydesen, Oakdale; James E. Zenk, St. Paul; Donald J. Goetzke, Woodbury; Bruce W. Carlson, Minneapolis; Claire A. Jalbert, St. Paul, all of Minn.

[73] Assignee: Imation Corp., Oakdale, Minn.

[21] Appl. No.: 09/209,298

[22] Filed: Dec. 10, 1998

[51] Int. Cl.[7] ..... G03G 15/00

[52] U.S. Cl. ..... 399/116; 399/162

[58] Field of Search ..... 399/116–117, 161, 399/162, 165; 206/308, 389, 393, 410, 391, 53

[56] References Cited

U.S. PATENT DOCUMENTS

| | | | |
|---|---|---|---|
| 3,877,806 | 4/1975 | Schrempp et al. | 355/16 |
| 3,888,577 | 6/1975 | Meyer | 355/3 R |
| 4,009,958 | 3/1977 | Kurita et al. | 355/16 |
| 4,319,829 | 3/1982 | Janeway, III et al. | 355/3 BE |
| 4,544,260 | 10/1985 | Kolbe | 355/3 BE |
| 4,766,455 | 8/1988 | Carter | 355/3 BE |
| 4,811,839 | 3/1989 | Cornell et al. | 206/203 |
| 4,860,898 | 8/1989 | Hiro et al. | 206/389 |
| 5,065,195 | 11/1991 | Haneda et al. | 355/298 |
| 5,119,133 | 6/1992 | Swain | 355/212 |
| 5,400,121 | 3/1995 | Foote | 335/212 |
| 5,417,322 | 5/1995 | Jeran et al. | 206/303 |
| 5,708,924 | 1/1998 | Shogren et al. | 399/116 |
| 5,809,375 | 9/1998 | Owens, Jr. et al. | 399/111 |
| 5,918,091 | 6/1999 | Saeki | 399/162 |
| 6,014,535 | 6/1999 | Zenk et al. | 399/116 |

FOREIGN PATENT DOCUMENTS

| | | | |
|---|---|---|---|
| 0 871 079 A1 | 10/1998 | European Pat. Off. | G03G 15/00 |
| 10-301445 | 11/1998 | Japan . | |

*Primary Examiner*—Quana Grainger
*Attorney, Agent, or Firm*—William D. Bauer

[57] ABSTRACT

Disclosed is a protective cover package for an endless, organic photoreceptor belt of an electrophotographic printer. The protective cover package is a flexible, closed loop sheet member which extends about an outer, photoreceptor coated surface of the endless belt. The photoreceptor coated surface of the endless belt is releasably secured to an inner surface of the sheet member, such that the sheet member supports the belt, and protects the photoreceptor surface from damage that would adversely affect the image reproduction quality of the belt. The sheet member has a belt loading configuration, that substantially duplicates the configuration of the endless belt when the belt is mounted onto support rollers of the electrophotographic printer. By replicating the configuration of the support rollers, loading of the belt onto the rollers is facilitated using the protective cover package. The sheet member also has a compact configuration that requires less volume than the belt loading configuration. The compact configuration of the sheet member minimizes shipping volume and storage space requirements for replacement photoreceptor belts.

21 Claims, 9 Drawing Sheets

PROTECTIVE COVER PACKAGE FOR AN ORGANIC PHOTORECEPTOR BELT

CROSS REFERENCE TO RELATED APPLICATIONS

This patent is related to U.S. patent application Ser. No. 09/209,189, entitled "Soft Cartridge Package for an Organic Photoreceptor Belt" filed on even date herewith and assigned to the same assignee; and to U.S. patent application Ser. No. 09/208,971, entitled "Hard Cartridge Package for an Organic Photoreceptor Belt" also filed on even date herewith and also assigned to the same assignee.

TECHNICAL FIELD

This invention relates to electrophotographic printers that employ organic photoreceptor belts. In particular, the present invention is a closed loop sheet that extends about and protects the organic photoreceptor coating on the outer surface of belt, thereby allowing a user to load a new organic photoreceptor belt into an electrophotographic printer without damaging or otherwise adversely affecting the image producing quality of the new belt.

BACKGROUND OF THE INVENTION

Throughout the business world, electrophotographic printers are extensively used for image reproduction. To effect image reproduction, one type of electrophotographic printer employs a belt having an organic photoreceptor coating thereon. As a result of various wear factors, the life span of the organic photoreceptor coating on the belt is less than the life span of the electrophotographic printer, thereby requiring that the organic photoreceptor coated belt be periodically replaced. The life span of the organic photoreceptor belt is limited because the organic photoreceptor coating layers deteriorate over time as a result of continued exposures to the imaging process. Consequently, the characteristics of the organic photoreceptor coating of the belt change and thereby adversely affect the quality of the reproduced image. In addition, the organic photoreceptor coating of the belt may include a release layer which tends to change its surface properties over time. The surface property changes of this release layer adversely affects the image quality of subsequent reproductions.

Within the business environment, the task of periodically replacing the organic photoreceptor coated belt is typically accomplished by office personnel instead of electrophotographic printer service technicians. To allow office personnel to perform the task of organic photoreceptor belt replacement, the organic photoreceptor belt can be packaged within a rigid cartridge. Typically, the process of used organic photoreceptor belt replacement is accomplished by completely exchanging the old cartridge containing the used organic photoreceptor belt for a new cartridge containing an unused organic photoreceptor belt. By packaging the organic photoreceptor belt within a rigid cartridge, organic photoreceptor belt replacement is more easily performed by office personnel. In addition, the rigid cartridge also protects the fragile organic photoreceptor coating of the belt from damage that can easily occur during the organic photoreceptor belt replacement process. Typically, the process of used organic photoreceptor belt replacement is accomplished by completely exchanging the old cartridge containing the used organic photoreceptor belt (and other consumables) for a new cartridge containing an unused organic photoreceptor belt (and other consumables). Although it may not be necessary to replace the other consumables contained within the cartridge since they may have a longer life than the belt (such as the belt rollers, etc.), the entire cartridge is replaced.

Although the above described typical, organic photoreceptor belt replacement cartridge design facilitates belt replacement and protects the organic photoreceptor coated belt from inadvertent damage, there are some disadvantages to this design. For example, since organic photoreceptor belt replacement also requires that an old cartridge be replaced with a new cartridge, the process of belt replacement creates a significant amount of consumables that must be disposed of. Not only is the used organic photoreceptor belt thrown away but the typical cartridge design necessitates that the used belt cartridge be disposed of with the used belt. All of the consumables within the cartridge are replaced, even though the organic photoreceptor belt may be the only item requiring replacement. This is of particular concern today with the ever increasing emphasis on decreasing office environment consumables. Moreover, because of the rigid design of the typical organic photoreceptor belt cartridge, there is the added concern of dealing with a bulky item in the trash. The rigid, bulky nature of the typical organic photoreceptor belt cartridge design creates other disadvantages as well. For example, a rigid cartridge packaged organic photoreceptor belt can require substantial supply shelf space within an office. In addition, a bulky, rigid organic photoreceptor belt cartridge can require considerable shipping container volume which translates into higher shipping costs. Moreover, the weight of a rigid organic photoreceptor belt cartridge further increases shipping costs. Lastly, the design of a rigid organic photoreceptor belt cartridge typically requires intricately shaped parts to accommodate the organic photoreceptor belt support roller configuration of the electrophotographic printer. This increases manufacturing costs and thereby the consumer cost of replacement organic photoreceptor belts.

There is a need for an improved protective package for replacement organic photoreceptor belts. In particular, there is a need for protective package that not only facilitates organic photoreceptor belt replacement and protects the replacement organic photoreceptor coated belt from inadvertent damage during the replacement process, but minimizes the amount of consumables that must be disposed of as a result of organic photoreceptor belt replacement. In addition, the protective package, for the replacement organic photoreceptor belt, should be of minimal shipping volume and weight, so as to minimize shipping costs and office supply shelf space requirements. Moreover, the organic photoreceptor belt protective package should provide these features while being relatively easy and inexpensive to manufacture.

SUMMARY OF THE INVENTION

The present invention is a protective cover package for an endless organic photoreceptor belt of an image forming apparatus, such as an electrophotographic printer.

In one embodiment, the present invention provides a protective cover package for an endless photoreceptor belt of an image forming apparatus, the endless photoreceptor belt having an outer, photoreceptor coated surface. The cover package includes a flexible, closed loop, sheet member having an inner surface and an outer surface. The closed loop sheet member extends about the outer, photoreceptor coated surface of the endless photoreceptor belt of the image forming apparatus. A releasable securing mechanism is provided on the inner surface of the closed loop sheet member which releasably secures the outer, photoreceptor coated surface of the endless belt to the inner surface of the closed loop sheet member, so that the sheet member supports the endless belt and protects the outer, photoreceptor coated surface of the endless belt from damage that would adversely affect image reproduction quality of the photoreceptor coated outer surface.

In one aspect, the releasable securing mechanism is a readily releasable, adhesive coating on the inner surface of the closed loop sheet member. The adhesive coating allows, upon application of a suitable force, the sheet member to be removed from the endless belt such that the adhesive coating stays on the inner surface of the sheet member and does not adversely affect the photoreceptor coated outer surface of the endless belt.

In another aspect, the releasable securing mechanism is surface energy of the inner surface of the closed loop sheet member. The surface energy provides an attractive force. The attractive force releasably holds the photoreceptor coated outer surface of the endless photoreceptor belt to the sheet member. Upon application of a suitable force, the releasable securing mechanism allows the sheet member to be removed from the endless belt without adversely effecting its photoreceptor coated outer surface.

In another aspect, the releasable securing mechanism is a static charge on the inner surface of the closed loop sheet member. The static charge provides an attractive force. The attractive force releasably holds the photoreceptor coated outer surface of the endless photoreceptor belt to the sheet member. Upon application of a suitable force, the releasable securing mechanism allows the sheet member to be removed from the endless photoreceptor belt without adversely affecting its photoreceptor coated outer surface.

The closed loop, sheet member is defined by a planar sheet of flexible material having first and second marginal edges that are joined together. In one aspect, the first and second marginal edges are joined via a butt joint held together by an adhesive backed strip.

In one aspect, the closed loop, sheet member has a width. The sheet member has a plurality of bends along its width such that the closed loop sheet member, with the endless photoreceptor belt supported therein, has a belt loading configuration. The belt loading configuration substantially duplicates a configuration of the endless photoreceptor belt when the endless photoreceptor belt is mounted onto support rollers of an image forming apparatus, so as to facilitate loading of the endless photoreceptor belt onto the support rollers. The flexibility of the sheet member allows the sheet member, with the endless belt supported therein, to assume a compact configuration. The compact configuration requires less volume than the belt loading configuration and facilitates storage and shipping of the endless belt.

In one aspect, one of the compact configuration in the belt loading configuration is a normal state of the sheet member and the other one of the compact configuration and the belt loading configuration is facilitated by an outer force. In one aspect, the normal state of the closed loop, sheet member is the compact configuration wherein the outer force that facilitates the belt loading configuration is provided by a user.

The endless belt is loaded onto the support rollers of the image forming apparatus by inserting the closed loop sheet member, with the belt supported therein, over the support rollers. The width of the sheet members is less than a width of the endless photoreceptor belt so as to permit a photoreceptor hold down mechanism, of the image forming apparatus, to hold the belt against movement relative to the support rollers, so that the sheet member can be removed from the support rollers and the belt, leaving only the belt on the support rollers of the image forming apparatus. Further, stop tabs may be provided on a side edge of the closed loop sheet member that keep the endless belt from moving relative to the sheet member when the member, with the belt supported therein, is supported over the support rollers. A grip mechanism may be provided on the sheet member to allow a user to grip the sheet member to facilitate the removal of the closed loop sheet member from around the endless belt and the support rollers. In one aspect, the grip mechanism includes a pair of oppositely positioned handles that extend outwardly from a side edge of the closed loop sheet member.

In one aspect, the first and second marginal edges of the closed loop sheet member are joined via a joining technique. The endless photoreceptor belt is loaded onto the support rollers of the image forming apparatus by inserting the closed loop sheet member, with the belt supported therein over the support rollers. The first marginal edge of the sheet member includes a flap to permit sheet member removal means, of the image forming apparatus, to grasp the flap and cause separation of the first and second marginal edges of the sheet member along the joining technique, so that the closed loop sheet member can be removed from around the belt and the support rollers, leaving only the belt on the support rollers of the image forming apparatus.

In another embodiment, the present invention provides a protective cover package for an endless, photoreceptor coated, belt having an outer surface, of an image forming apparatus. The cover package includes an endless belt having an outer surface coated with a photoreceptor. A protective, removable, coating covers the outer surface of the endless photoreceptor coated belt. The coating protects the outer surface of the endless photoreceptor belt from damage that would adversely affect image reproduction quality of the photoreceptor coated outer surface.

In one aspect, the coating is a thin film coating. In another aspect, the coating is ink. The ink is readily removed from the outer, photoreceptor coated surface of the endless photoreceptor belt by cycling the endless photoreceptor belt through an image forming cycle of the image forming apparatus. In another aspect, the coating is wax. The wax is readily removed from the outer, photoreceptor coated surface of the endless photoreceptor belt by heating the endless photoreceptor for a period of time.

In another embodiment, the present invention provides a method of loading an endless photoreceptor belt onto support rollers of an image forming apparatus. The method includes the step of providing a closed loop, sheet member extending about an outer surface of the endless photoreceptor belt. An inner surface of the sheet member includes a mechanism for releasably securing the outer surface of the endless photoreceptor belt to the inner surface of the sheet member. The sheet member, with the endless photoreceptor belt supported therein, has a configuration that substantially duplicates a configuration of support rollers of the image forming apparatus. The sheet member is aligned with the support rollers of the image forming apparatus such that the configuration of the sheet member matches the configuration of the support rollers. The closed loop sheet member is moved onto the support rollers such that the sheet member, with the endless photoreceptor belt supported therein, is fully on the supported rollers. The closed loop sheet member is removed from around the endless photoreceptor belt and the support rollers leaving only the belt on the support rollers of the image forming apparatus. The endless photoreceptor belt is tensioned to make the belt ready for image reproduction.

In one aspect, the step of removing the closed loop sheet member from around the endless photoreceptor belt and the support rollers includes the step of holding the belt against movement relative to the support rollers using a photoreceptor belt hold down mechanism of the image forming apparatus, so that the sheet member can be removed from the belt without altering the position of the belt. A grip mechanism is grasped on the sheet member to facilitate removal of the sheet member from around the belt and the support rollers.

In another aspect, the step of removing the closed loop sheet member from around the endless photoreceptor belt and the support rollers includes the step of actuating a sheet member removal mechanism of the image forming apparatus which is engaged with a removal flap on the sheet member and causes the sheet member to separate along its marginal edges and removes the sheet member from the endless photoreceptor belt without altering the position of the belt. The sheet member is removed from the sheet member removal means.

The protective cover package of the present invention, whether in the belt loading configuration or the compact configuration, protects the organic photoreceptor belt from damaging bends and creases that would adversely affect the image reproduction quality of the replacement organic photoreceptor belt. In addition, the protective cover package protects the fragile organic photoreceptor coating of the belt from other damage, in the form of finger prints, scratches and/or abrasions, caused by organic photoreceptor belt mishandling by office personnel during the replacement process. This protective cover package provides protection during the organic photoreceptor belt replacement process since office personnel may need only touch the closed loop sheet member of the cover package during the replacement process and not the organic photoreceptor belt itself. In addition to providing organic photoreceptor belt protection, the protective cover package of the present invention minimizes, when compared to prior art designs, the amount of consumables that must be disposed of as a result of the organic photoreceptor belt replacement process. Moreover, the protective cover package of the present invention in its compact configuration facilitates storage and shipping of replacement organic photoreceptor belts since the compact configuration requires less volume than the belt loading configuration. By minimizing the shipping volume and weight of the organic photoreceptor belt replacement, the protective cover package of the present invention also minimizes shipping costs and office supply shelf space requirements. Lastly, this organic photoreceptor belt protective cover package also provides these features while being relatively easy and inexpensive to manufacture.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
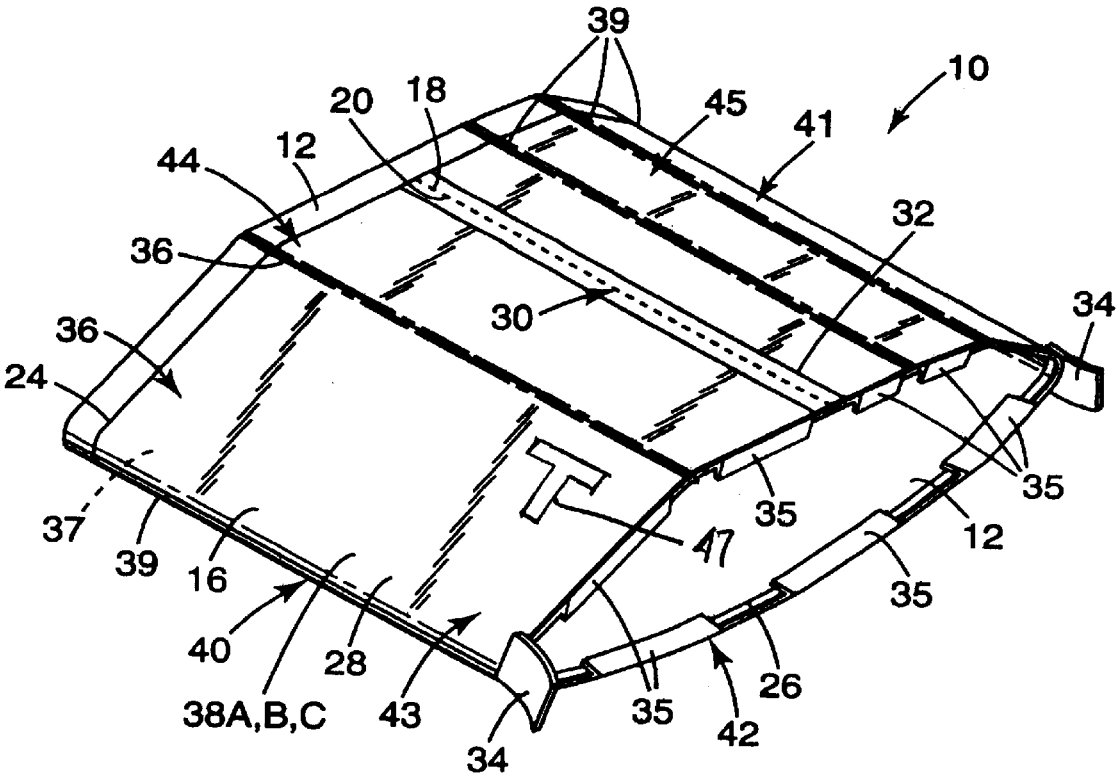
FIG. 1 is a perspective view of a protective cover package for replacement, endless, organic photoreceptor belts for an electrophotographic printer in accordance with the present invention.
Figure 2:
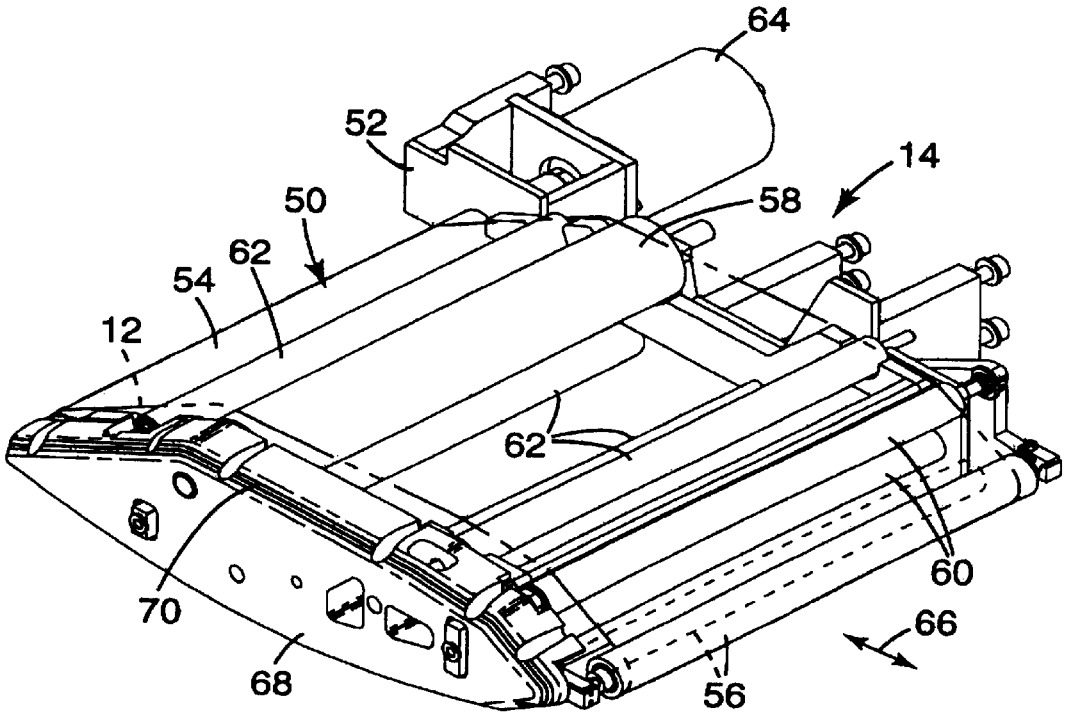
FIG. 2 is a perspective view of a support roller system for the organic photoreceptor belt of the electrophotographic printer.
Figure 3:
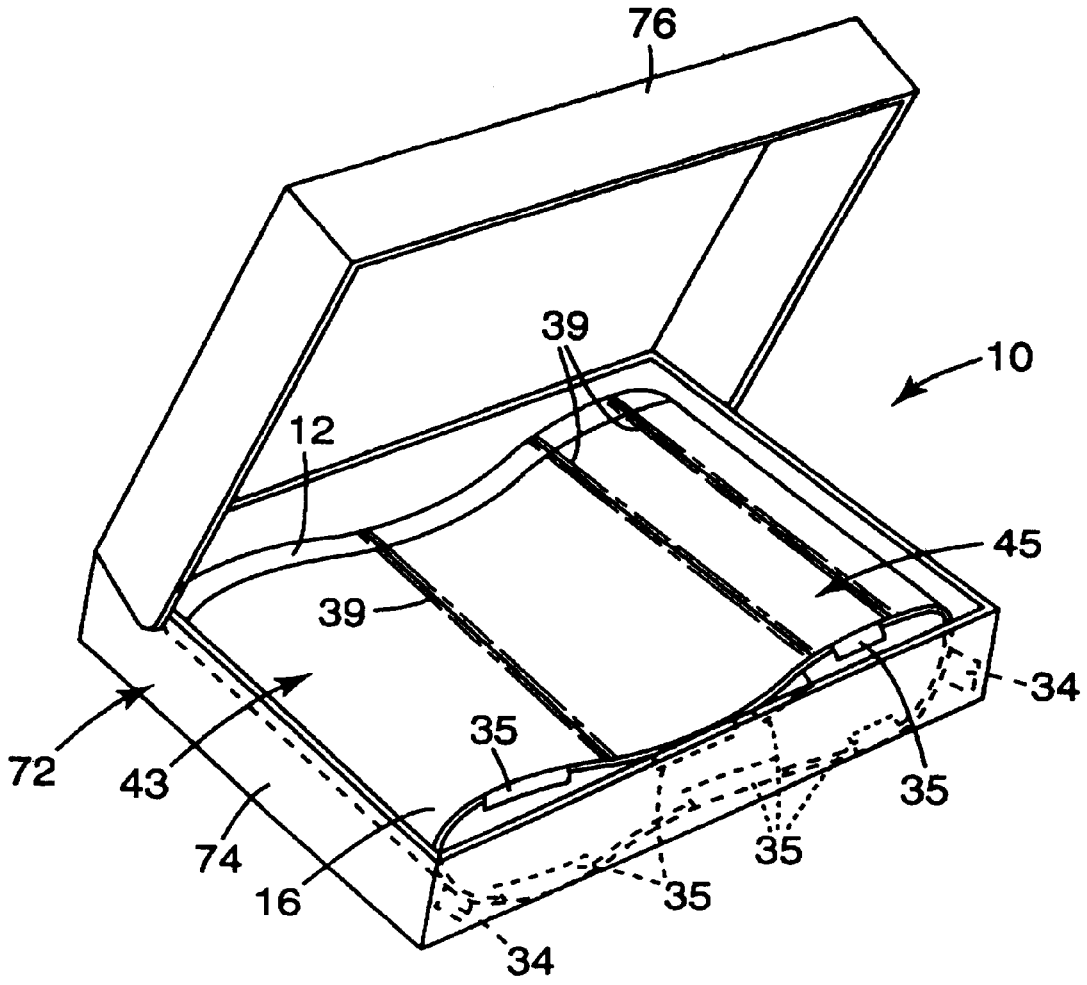
FIG. 3 is a perspective view of the protective cover package of FIG. 1 shown in a shipping container.

A protective cover package 10 for an endless, organic photoreceptor belt 12 of an image forming apparatus, such as for a belt transport system 14 in an electrophotographic printer, in accordance with the present invention is illustrated generally in FIGS. 1–3. One exemplary embodiment of an electrophotographic system is described in detail in a pending patent application filed Sep. 29, 1995, assigned to 3M Company, designated as U.S. patent application Ser. No. 08/537,296, entitled "A Method and Apparatus for Producing a Multi-Color Image in an Electrophotographic System" (Kellie et al.). This pending patent application is incorporated herein by reference.

The protective cover package 10 is defined by a closed loop sheet member 16 which is manufactured from a sheet of flexible material. The closed loop sheet member 16 includes first and second marginal edges 18 and 20, respectively, first and second side edges 22 and 24, respectively, and inner and outer surfaces 26 and 28, respectively. The first marginal edge 18 is joined to the second marginal edge 20 at a butt joint 30 that is held together via a suitable adhesive backed strip 32. Although a simple butt joint 30 is illustrated in FIG. 1, other types of joints such as a simple lap joint or an interleaved lap joint may also be used to join the first and second marginal edges 18 and 20.

As seen best in FIG. 1, the first side edge 22 of the sheet member 16 includes a pair of oppositely positioned, grips or handles 34 that facilitate handling of the cartridge device 10. The handles 34 can be secured to the sheet member 16 via a suitable adhesive or can be unitary with the sheet member 16. The first side edge 22 of the sheet member 16 also includes a plurality of spaced, unitary stop tabs 35 which prevent the organic photoreceptor belt 12 from sliding out of the sheet member 16 past the first side edge 22.

In one preferred embodiment, the flexible material of the closed loop sheet member 16 is made of a polymeric material (e.g., PET, mylar, or vinyl).

As can be seen best in FIG. 1, the closed loop sheet member 16 of the protective cover package 10 extends about an outer, photoreceptor coated surface 37 of the organic photoreceptor belt 12. The inner surface 26 of the sheet member 16 includes a releasable securing mechanism 36 which releasably secures the outer, photoreceptor coated surface 37 of the organic photoreceptor belt 12 to the inner surface 26 of the sheet member 16. By releasably securing the organic photoreceptor belt 12 to the sheet member 16, the sheet member 16 provides structural support to the organic photoreceptor belt 12 and protects the outer, photoreceptor coated surface 37 of the organic photoreceptor belt 12 from damage that would adversely affect the image reproduction quality of the organic photoreceptor belt 12. In one preferred embodiment, the releasable securing mechanism 36 is readily releasable, adhesive coating 38A. The adhesive coating 38A allows, upon application of a suitable force, the sheet member 16 to be removed from the organic photoreceptor belt 12 such that the adhesive coating 38A stays on the inner surface 26 of the sheet member 16 and does not adversely affect the outer, photoreceptor coated surface 37 of the organic photoreceptor belt 12.

In an alternative embodiment, the releasable securing mechanism 36 is surface energy 38B on the inner surface 26 of the sheet member 16. This surface energy 38B provides an attractive force that releasably holds the photoreceptor coated outer surface 37 of the organic photoreceptor belt 12 to the inner surface 26 of the sheet member 16. However, this surface energy 38B, upon application of a suitable force, allows the sheet member 16 to be removed from the organic photoreceptor belt 12 without adversely affecting the outer, photoreceptor coated surface 37.

In a further alternative embodiment, the releasable securing mechanism 36 is a static charge 38C on the inner surface 26 of the sheet member 16. Like the surface energy 38B, the static charge 38C provides an attractive force that releasably holds the photoreceptor coated outer surface 37 of the organic photoreceptor belt 12 to the inner surface 26 of the sheet member 16. In addition, like the surface energy 38B, the static charge 38C, upon application of a suitable force, allows the sheet member 16 to be removed from the organic photoreceptor belt 12 without adversely affecting the outer, photoreceptor coated surface 37.

As seen best in FIG. 1, the sheet member 16 of the protective cover package 10 has a plurality of widthwise extending prebends 39. These prebends 39 dictate the particular shape of the sheet member 16 defined by end regions 40 and 41, curved bottom region 42, and upper planar regions 43, 44 and 45. This particular shape or configuration of the resilient sheet member 16 and is referred to as the belt loading configuration of the protective cover package 10. This belt loading configuration (i.e., shape) of the protective cover package 10 substantially duplicates the configuration of the endless organic photoreceptor belt 12 (see FIG. 2) when the belt 12 is mounted on a support roller system 50 of the belt transport system 14. As will become clear below, by duplicating the configuration of the organic photoreceptor belt 12 on the support roller system 50 (and therefore the configuration of the support roller system 50 itself), the shape of the belt loading configuration of the protective cover package 10 also facilitates loading of the belt 12 onto the support roller system 50 of the belt transport system 14.

Optionally, protective cover package 10 may include indicia 47. The indicia 47 may be located on an inner or outer major surface of protective cover package 10. Indicia 47 may include images or characters, such as artistry, pictures, trademarks, trade names, or directions which may correspond to utilization of the protective cover package 10. In one embodiment, indicia 47 is printed on protective cover package 10 (e.g., by laser printing, ink printing, etc.).

As seen best in FIG. 2, the support roller system 50 of the belt transport system 14 includes a mounting frame 52 having a drive roller 54, a belt tensioning roller 56, a primary nip roller 58, a pair of stabilizing rollers 60, and a plurality of idler rollers 62 (only some of which can be seen in FIG. 2). The drive roller 54 rotates in a known manner via a drive motor 64 to move the endless organic photoreceptor belt 12 about the support roller system 50. The belt tensioning roller 56 is longitudinally movable, in a known manner, in the direction of double headed arrow 66 to allow de-tensioning and tensioning of the organic photoreceptor belt 12 for organic photoreceptor belt replacement. In FIG. 2, the belt tensioning roller 56 is shown in an organic photoreceptor belt tensioned state in solid lines and in a belt de-tensioned state in dashed lines. As seen best in FIG. 2, the support roller system 50 further includes a tip member 68 having a cone shaped, peripheral edge 70. As will become clear below, the cone shaped, peripheral edge 70 of the tip member 68 facilitates loading of a replacement organic photoreceptor belt 12 onto the support roller system 50 by guiding the protective cover package 10 over and onto the rollers 54, 56, 58, 60 and 62.

As seen best in FIG. 3, the flexible sheet member 16 of the protective cover package 10 also has as its normal state a compact configuration in addition to the expanded belt loading configuration shown in FIG. 1. In the compact configuration the protective cover package 10 requires less volume than the belt loading configuration, and therefore, facilitates shipping and storage of a replacement organic photoreceptor belt 12 supported on the inner surface 26 of the flexible sheet member 16. In addition, by minimizing the volume required for the protective cover package 10 and replacement organic photoreceptor belt 12, the protective cover package 10 also minimizes shipping and storage costs. Since the sheet member 16 of the protective cover package 10 is formed of a flexible material, the flexibility of the material allows the protective cover package 10, with the organic photoreceptor belt 12 therein, to move between its lesser volume compact configuration and its greater volume belt loading configuration. An outside force, such as may be provided by a container or box, may also provide for further compaction of protective cover package 10. In addition, since the compact configuration is the normal state of the sheet member 16 of the protective cover package 10, an outer force, such as provided by a user, is required to maintain the protective cover package 10 in its belt loading configuration.

As seen in FIG. 3, in its compact state, the protective cover package 10 is housed within a container 72 having a lower box portion 74 and a hinged lid 76. The lid 76 of the container 72 is shown open to better illustrate the compact configuration of the protective cover package 10 with the organic photoreceptor belt 12 therein. When the lid 76 is opened, and the protective cover package 10 is removed from the box portion 74, with the help of a user, the protective cover package 10 is held in its belt loading configuration and is ready for the belt replacement process.

FIGS. 4–7 illustrate the operation of loading a replacement organic photoreceptor belt 12 onto the support roller system 50 of an belt transport system 14 using the protective cover package 10 in accordance with the present invention. To begin, the belt tensioning roller 56 is moved by a user, such as an office worker, to its de-tensioned state. The used organic photoreceptor belt is then simply slid off of the support roller system 50 and discarded. Then, with the belt tensioning roller 56 still in its de-tensioned state, the compact configuration, protective cover package 10, with the replacement organic photoreceptor belt 12 supported therein, is removed from the container 72. With the help of the user, the protective cover package 10 is held in its belt loading configuration. As seen best in FIGS. 4 and 5, with the protective cover package 10 in its belt loading configuration, the user aligns the sheet member 16 with the support roller system 50 such that the shape of the protective cover package 10 matches that shape of the roller system 50 (i.e., the tip member 68). The protective cover package 10, with the endless, replacement organic photoreceptor belt 12 supported therein, is then slid, by the user, fully onto the support roller system 50 (see FIG. 6) such that an inner surface of the organic photoreceptor belt 12 engages the rollers 54, 56, 58 60 and 62. As seen best in FIG. 5, the cone shaped peripheral edge 70 of the tip member 68 facilitates loading of the organic photoreceptor belt 12 by guiding the sheet member 16 onto and over the support roller system 50 of the belt transport system 14.

Figure 4:
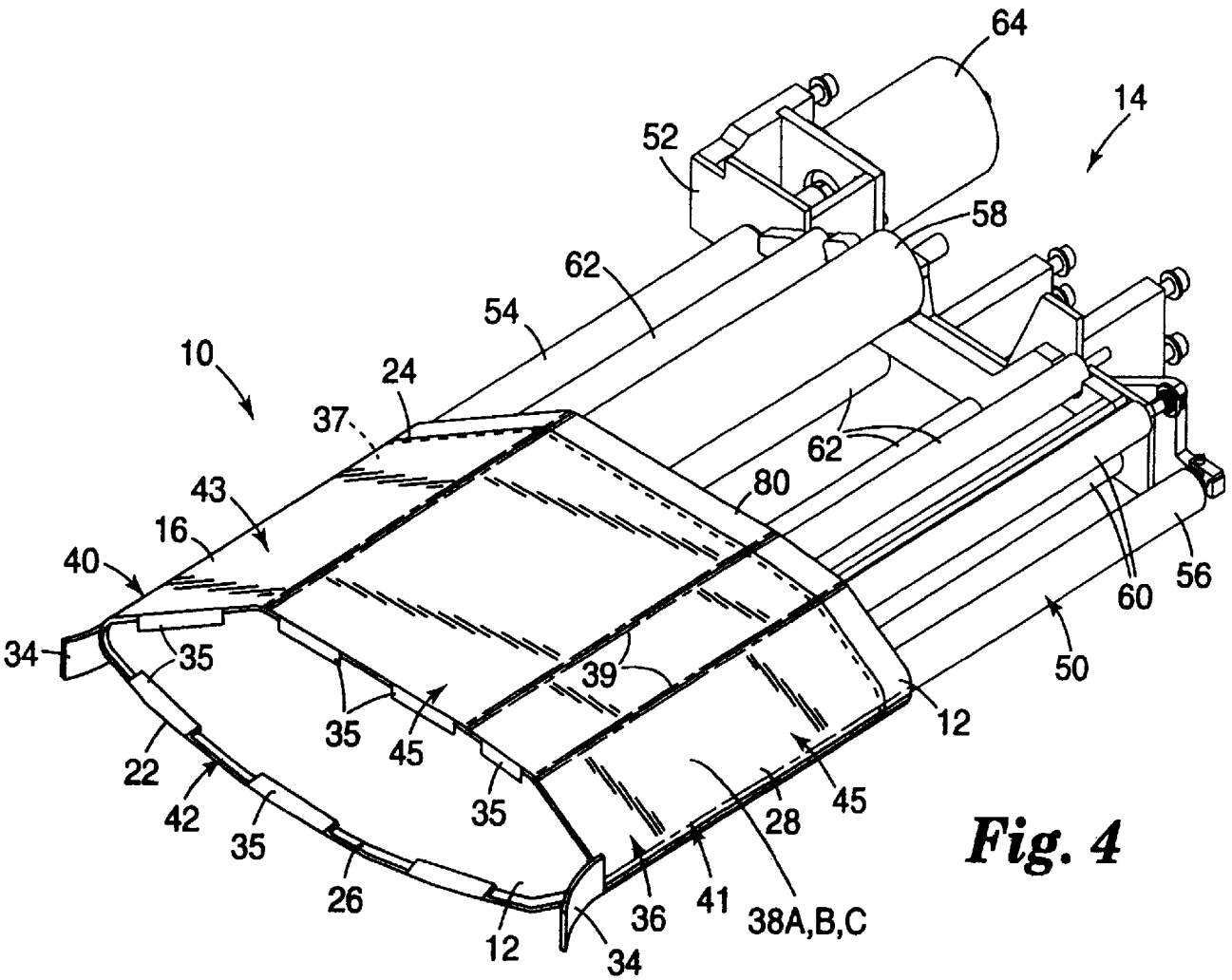
FIG. 4 is a perspective view showing the protective cover package of FIG. 1 surrounding an organic photoreceptor belt and being moved onto the support roller system of the electrophotographic printer.
Figure 5:
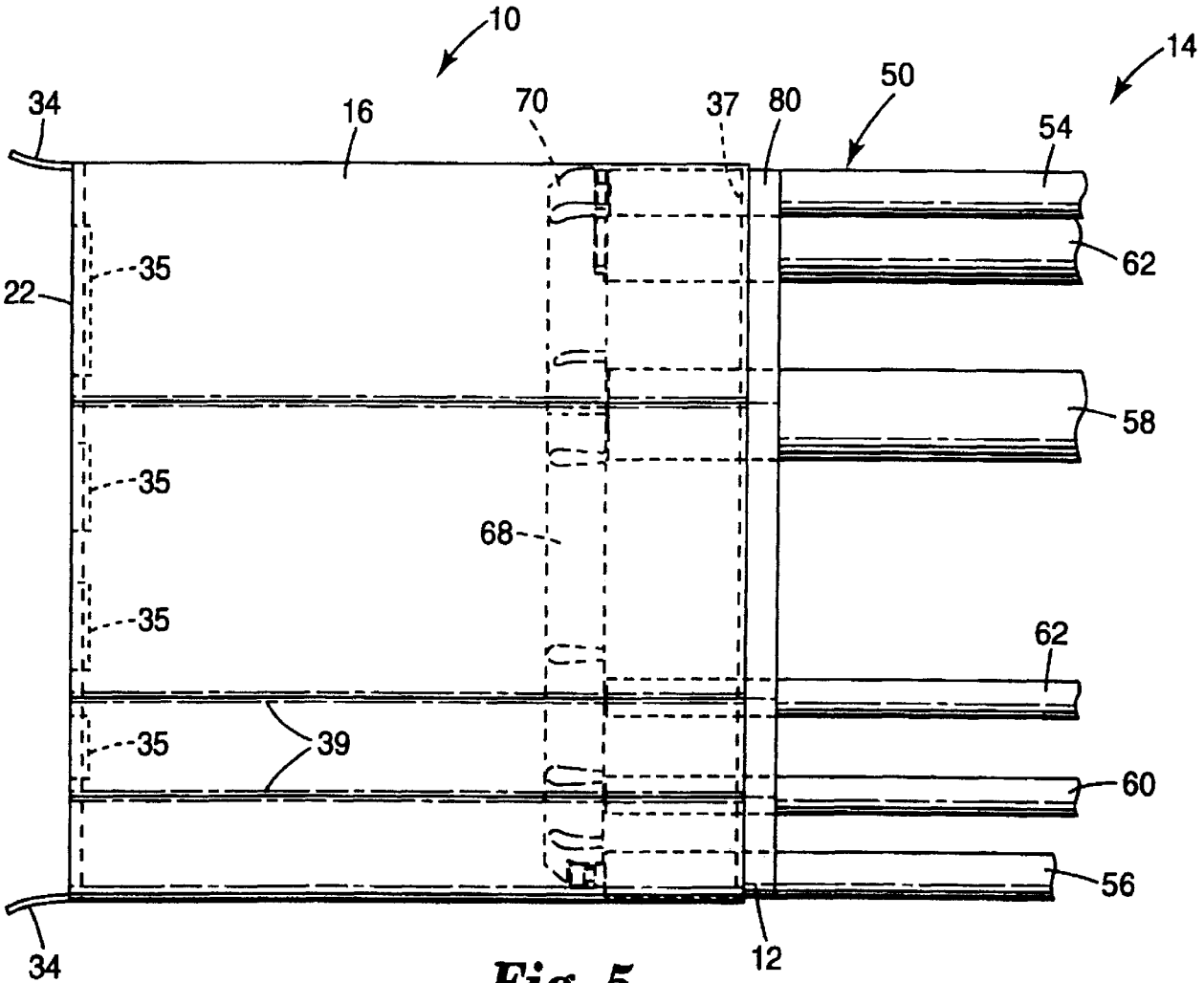
FIG. 5 is a top elevational view illustrating a cone-shaped tip member of the support roller system that facilitates insertion of the protective cover package and organic photoreceptor belt onto the support roller system of the electrophotographic printer.

As seen best in FIG. 4, the width of the sheet member 16 of the protective cover package 10 is less than the width of the organic photoreceptor belt 12, thereby exposing an end portion 80 of the organic photoreceptor belt 12 extending beyond the second side edge 24 of the sheet member 16. However, the inner surface 26 of the sheet member 16 fully covers the fragile, photoreceptor coated outer surface 37 of the organic photoreceptor belt 12, thereby protecting the photoreceptor coated outer surface 37 from damage during the replacement process. In fact the sheet member 16 provides sufficient structural support to the replacement organic photoreceptor belt 12 that the user need never touch any part of the replacement organic photoreceptor belt 12 during the organic photoreceptor belt replacement process.

Figure 6:
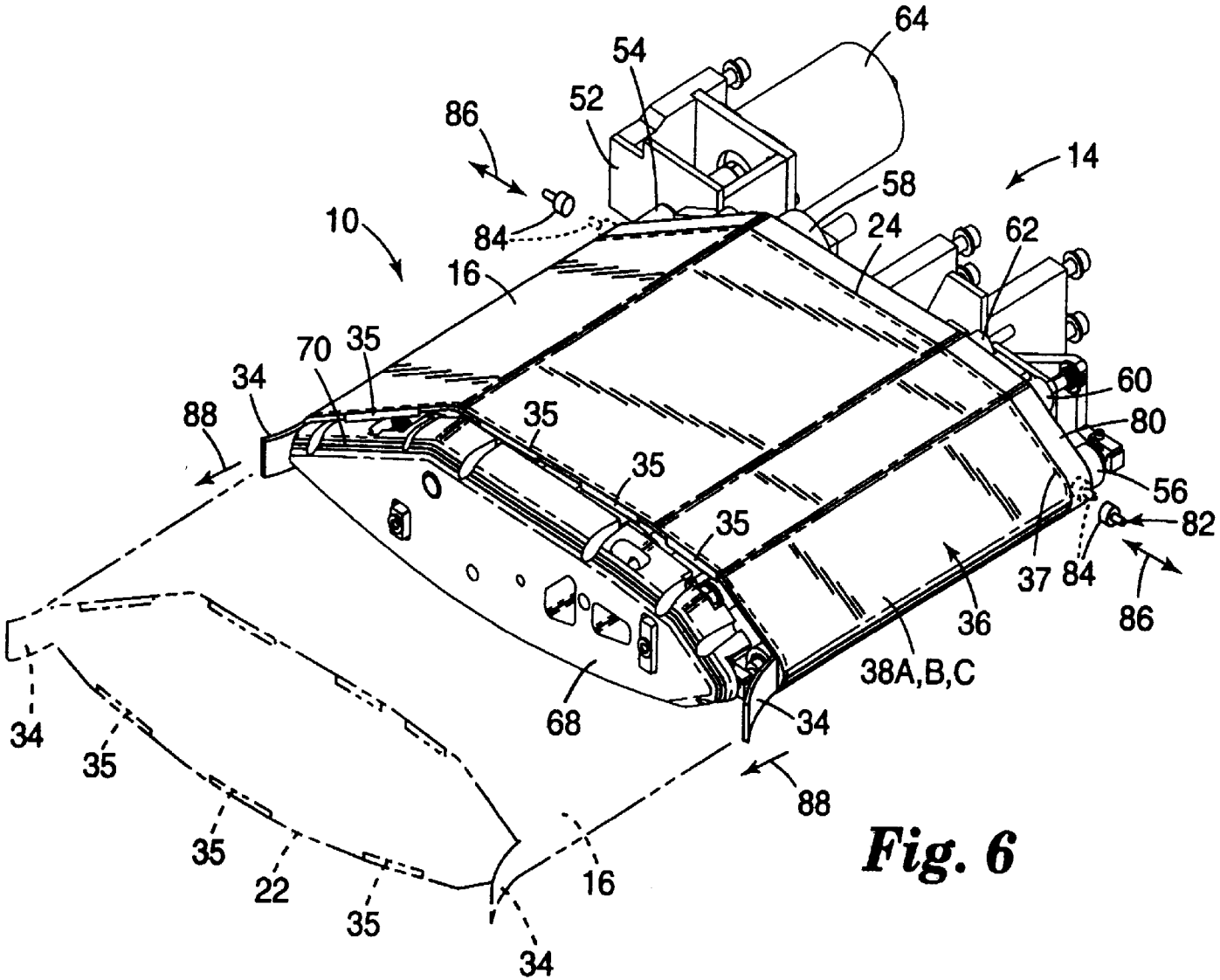
FIG. 6 is a perspective view similar to FIG. 4 showing the protective cover package and organic photoreceptor belt fully inserted over the support roller system of the electrophotographic printer.

As seen best in FIG. 6, the free end portion 80 of the organic photoreceptor belt 12 allows a hold down mechanism 82, of the belt transport system 14, to move into engagement with this free end portion 80, of the organic photoreceptor belt 12, to hold the replacement organic photoreceptor belt 12 against movement relative to the support roller system 50. Hold down mechanism 82 includes a pair of mushroom shaped holders 84 that are longitudinally movable, as represented by double headed arrows 86, between a disengaged position (solid lines) and an engaged position (dashed lines). With the protective cover package 10 fully on the support roller system 50, the user causes the holders 84 to move inward to engage the free end portion 80 of the organic photoreceptor belt 12. The holders 84, in their engaged positions, hold the belt 12 against the drive roller 54 on one side of the roller system 50 and against the belt tensioning roller 56 on the other side of the roller system 50. This fixes the endless, replacement organic photoreceptor belt 12 in place and allows the user, by grasping the handles 34, to slide the sheet member 16 out (see arrows 88) from around the organic photoreceptor belt 12 and the roller system 50. The releasable securing mechanism 36 allows the user to remove the sheet member 16 from the organic photoreceptor belt 12 with minimal force.

Figure 7:
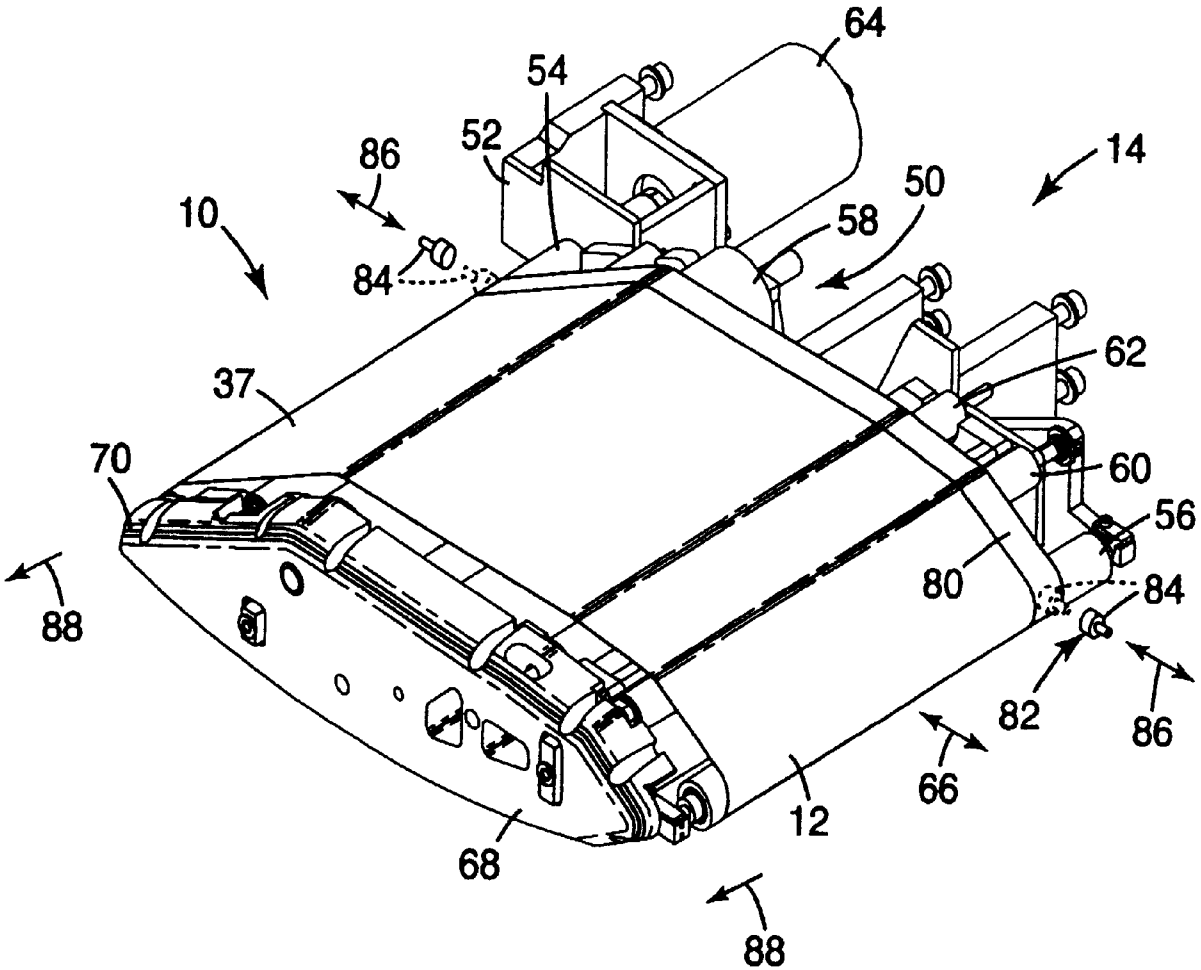
FIG. 7 is a perspective view similar to FIG. 4 of the support roller system with the organic photoreceptor belt thereon and with the protective cover package removed therefrom.

As seen best in FIG. 7, this action removes the protective cover package 10 from the belt transport system 14 leaving the replacement organic photoreceptor belt 12 in place on the support roller system 50. The relatively unbulky protective cover package 10 is then discarded. The holders 84 are then moved by the user out of engagement with the replacement organic photoreceptor belt 12 (i.e., to their disengaged position), and the belt tensioning roller 56 is moved to its tensioned state which tensions the replacement organic photoreceptor belt 12 and completes the replacement process.

Figure 8:
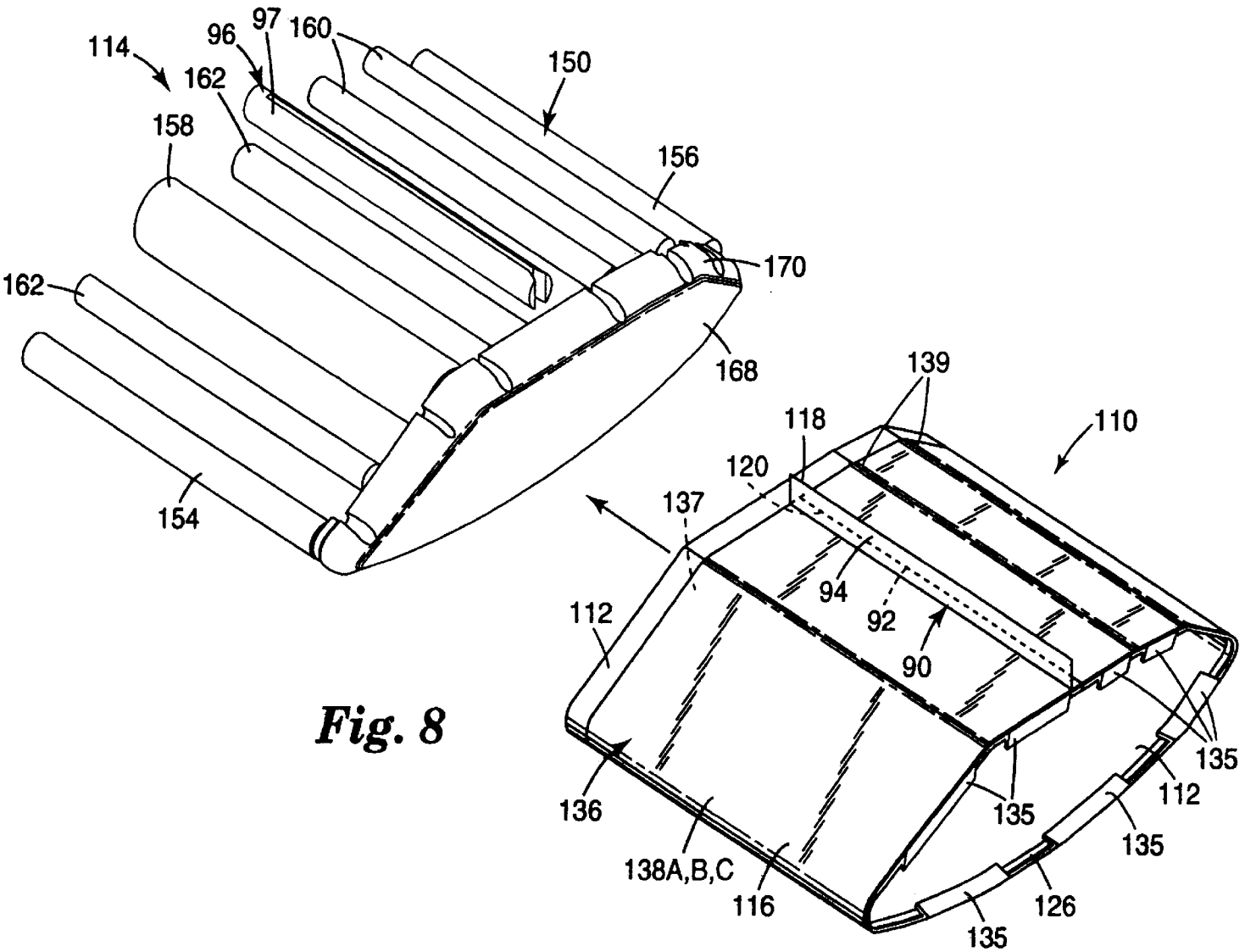
FIG. 8 is a perspective view illustrating an alternative embodiment of the protective cover package in accordance with the present invention.
Figure 9:
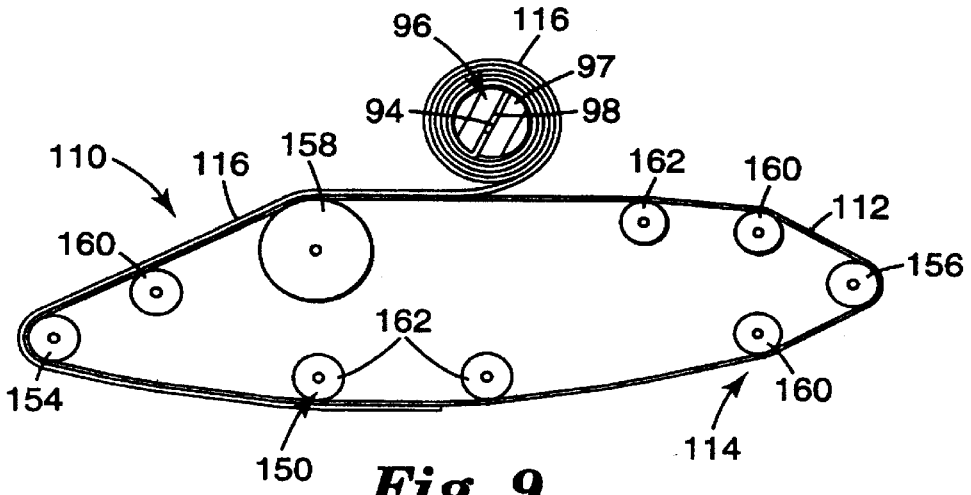
FIG. 9 is an end elevational view illustrating the alternative embodiment of the protective cover package being removed from the organic photoreceptor belt.
Figure 10:
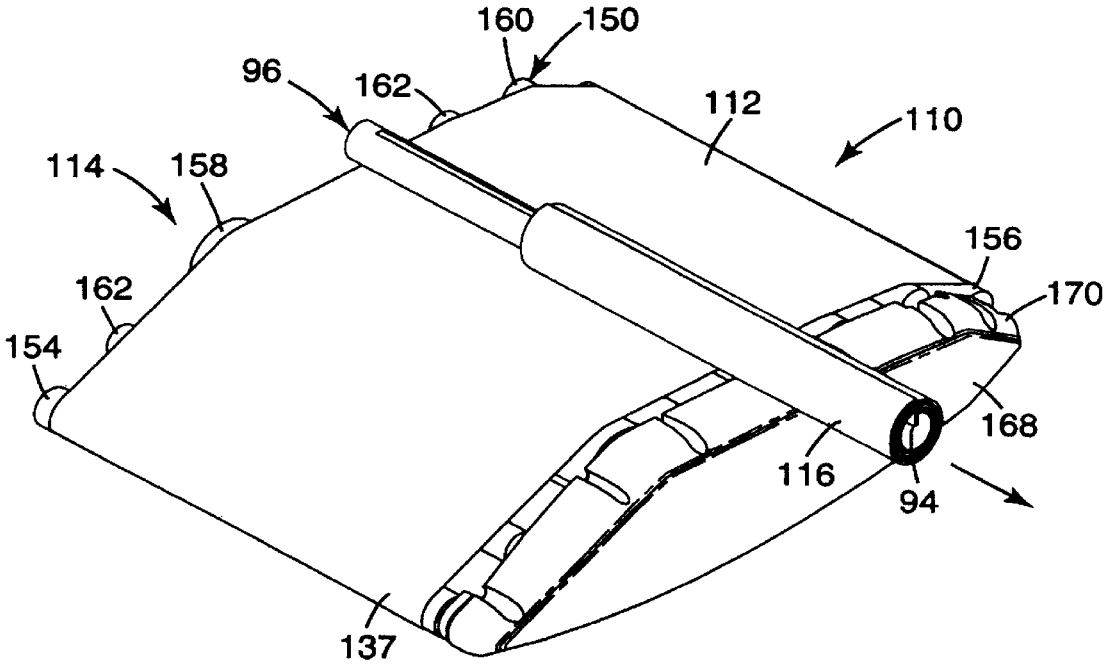
FIG. 10 is a perspective view of the support roller system with the organic photoreceptor belt thereon and of the alternative embodiment of the protective cover package being removed from the support roller system.

FIGS. 8–10 illustrate an alternative protective cover package embodiment 110. Like parts are labeled with like numerals except for the addition of the prescript 1. In the alternative protective cover package 110, the handles 34 have been eliminated from the sheet member 116. In addition, in the alternative embodiment of the protective cover package 110, the first and second marginal edges 118 and 120 are joined at a lap joint 90, which is held together via a readily releasable adhesive 92, such that the first marginal edge 118 defines a flap 94. Further, the electrophotographic printer 114 includes a cartridge device removal mechanism 96 that includes a take-up roller 97.

In operation, as seen best in FIGS. 8 and 9, upon insertion of the protective cover package 110, with the replacement organic photoreceptor belt 112 supported therein, onto the roller system 150, the flap 94 slides into a groove 98 of the take-up roller 97. Once the protective cover package 110 is fully on the support roller system 150, the user rotates the take-up roller 97 which causes the sheet member 116 to separate along its marginal edges 118 and 120 due to the use of the readily releasable adhesive 92. As seen best in FIG. 9 further rotation of the take-up roller 97 causes the sheet member 16 of the protective cover package 110 to be completely removed from around the replacement organic photoreceptor belt 112 and the support roller system 150 and to be wound onto the take-up roller 97. This leaves only the replacement organic photoreceptor belt 112 on the roller system 150 of the electrophotographic printer 114. As seen best in FIG. 10, once the sheet member 116 is fully wound onto the take-up roller 97, the user merely slides the sheet member 116 off of the take-up roller 97 and discards the sheet member 116 defining the protective cover package 10. Tensioning of the replacement organic photoreceptor belt 112 completes the organic photoreceptor belt replacement process.

Figure 11:
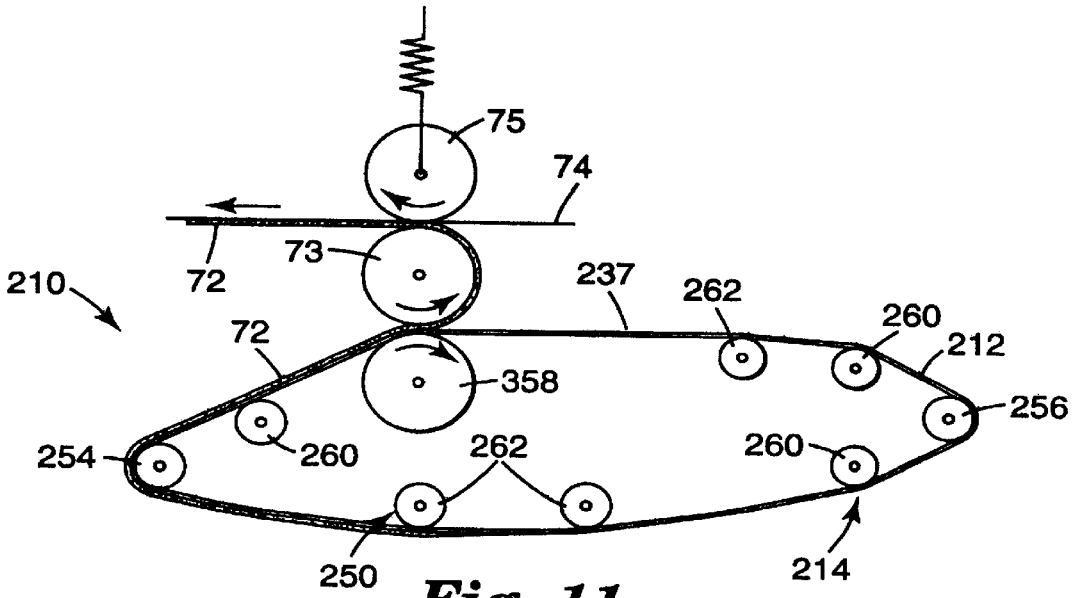
FIG. 11 is an end elevational view of a further alternative embodiment of the protective cover package in accordance with the present invention.

FIG. 11 illustrates a further alternative embodiment of the protective cover package 210. Like parts are labeled with like numerals except for the addition of the prescript 2. Coated outer surface 237 is protected by a film coating, which in one embodiment is a thin film coating. In one exemplary embodiment, the photoreceptor coated outer surface 237 of the organic photoreceptor belt 212 is protected by a readily removable, thin film ink coating 72. The thin film ink coating 72 protects the photoreceptor coated outer surface 237 of the organic photoreceptor belt 212 from damage that would adversely affect the image reproduction quality of the replacement organic photoreceptor belt 212. The thin film ink coating 72 is readily removed from the outer, photoreceptor coated surface 237 of the organic photoreceptor belt 212 by cycling the organic photoreceptor belt 212 through an image forming cycle of the electrophotographic printer 214. During the image forming cycle, a transfer roller 73 removes the ink coating 72 from the photoreceptor coated surface 237, and transfers the removed ink coating 72 to a sheet of paper 74 with the help of a pressure roller 75.

Figure 12:
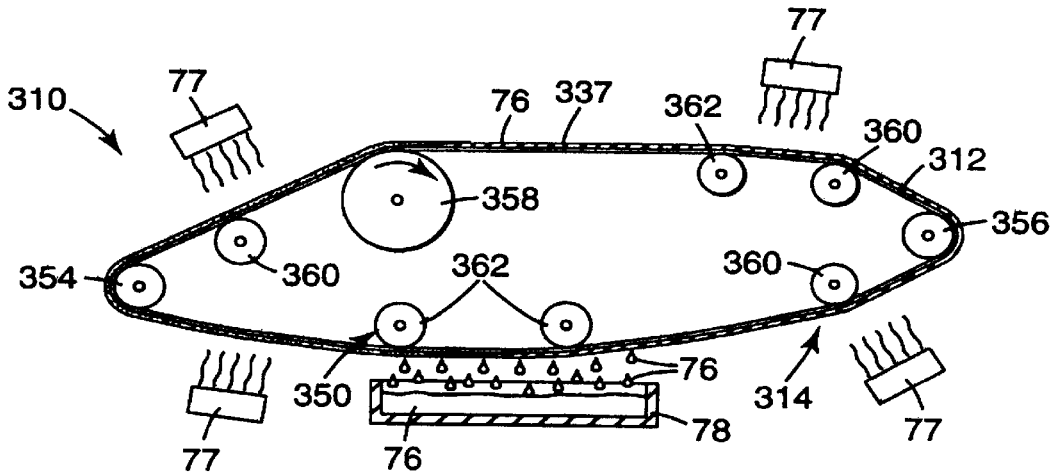
FIG. 12 is an end elevational view of still another alternative embodiment of the protective cover package in accordance with the present invention.

FIG. 12 illustrates a still further alternative embodiment of the protective cover package 310. Like parts are labeled with like numerals except for the addition of the prescript 3. In the protective cover package 310, the photoreceptor coated outer surface 337 of the organic photoreceptor belt 312 is protected by a readily removable, thin film wax coating 76. The thin film wax coating 76 protects the photoreceptor coated outer surface 337 of the organic photoreceptor belt 312 from damage that would adversely affect the image reproduction quality of the replacement organic photoreceptor belt 312. The thin film wax coating 76 is readily removed from the outer, photoreceptor coated surface 337 of the organic photoreceptor belt 312 by heating the organic photoreceptor belt 312 for a period of time using heaters 77. The heat melts the wax coating 76 from the photoreceptor coated surface 337 of the replacement organic photoreceptor belt 312. The removed wax coating 76 is collected in a pan 78.

The protective cover package 10, 110, 210, 310 of the present invention protects the organic photoreceptor belt 12, 112, 212, 312 from damaging bends and creases that would adversely affect the image reproduction quality of the replacement organic photoreceptor belt 12, 112, 212, 312. In addition, the protective cover package 10, 110, 210, 310 protects the fragile organic photoreceptor coating 37, 137, 237, 337 of the belt 12, 112, 212, 312 from other damage, in the form of finger prints, scratches and/or abrasions, caused by organic photoreceptor belt mishandling by office personnel during the replacement process. The protective cover package 10, 110, 210, 310 provides protection during the organic photoreceptor belt replacement process since office personnel need not touch the fragile organic photoreceptor coating 37, 137, 237, 337 of the belt 12, 112, 212, 312 during the replacement process. In addition to providing organic photoreceptor belt protection, the protective cover package 10, 110, 210, 310 of the present invention minimizes, when compared to prior art designs, the amount of consumables that must be disposed of as a result of the organic photoreceptor belt replacement process. Moreover, the protective cover package 10, 110, 210, 310 of the present invention in its compact configuration facilitates storage and shipping of replacement organic photoreceptor belts 12, 112, 212, 312 since the compact configuration requires less volume than the belt loading configuration. By minimizing the shipping volume and weight of the organic photoreceptor belt replacement, the protective cover package 10, 110, 210, 310 of the present invention also minimizes shipping costs and office supply shelf space requirements. Lastly, this protective cover package 10, 110, 210, 310 also provides these features while being relatively easy and inexpensive to manufacture.

Although the present invention has been described with reference to preferred embodiments, workers skilled in the art will recognize that changes may be made in form and detail without departing from the spirit and scope of the invention.

What is claimed is:

1. A protective cover package for an endless photoreceptor belt of an image forming apparatus, the endless photoreceptor belt having an outer photoreceptor coated surface, the cover package comprising:

a flexible, closed loop sheet member having an inner surface and an outer surface, the closed loop sheet member extending about the outer photoreceptor coated surface of the endless photoreceptor belt of the image forming apparatus, wherein the closed loop sheet member has a width and a plurality of bends along its width, such that the closed loop sheet member, with the endless belt support therein, has a belt loading configuration that substantially duplicates a configuration of the endless photoreceptor belt when the endless photoreceptor belt is mounted onto support rollers of an image forming apparatus, so as to facilitate loading of the endless photoreceptor belt onto the support rollers; and a releasable securing article on the inner surface of the closed loop sheet member which contacts the outer photoreceptor coated surface of the endless belt and releasably secures the outer photoreceptor coated surface of the endless belt to the inner surface of the closed loop sheet member, so that the sheet member supports the endless belt and protects the outer photoreceptor coated surface of the endless belt from damage that would adversely affect image reproduction quality of the photoreceptor coated outer surface.

2. The protective cover package of claim 1 wherein the releasable securing article is a readily releasable adhesive coating on the inner surface of the closed loop sheet member, the adhesive coating allowing, upon application of a suitable force, the sheet member to be removed from the endless belt such that the adhesive coating stays on the inner surface of the sheet member and does not adversely affect the photoreceptor coated outer surface of the endless belt.

3. The protective cover package of claim 1 wherein the releasable securing article is surface energy of the inner surface of the closed loop sheet member, the surface energy providing an attractive force that releasably holds the photoreceptor coated outer surface of the endless photoreceptor belt to the sheet member but, upon application of a suitable force, allows the sheet member to be removed from the endless belt without adversely affecting its photoreceptor coated outer surface.

4. The protective cover package of claim 1 wherein the releasable securing article is a static charge on the inner surface of the closed loop sheet member, the static charge providing an attractive force that releasably holds the photoreceptor coated outer surface of the endless photoreceptor belt to the sheet member but, upon application of a suitable force, allows the sheet member to be removed from the endless belt without adversely affecting its photoreceptor coated outer surface.

5. The protective cover package of claim 1 wherein the closed loop sheet member is defined by a planar sheet of flexible material having first and second marginal edges that are joined together.

6. The protective cover package of claim 5 wherein the first and second marginal edges are joined via a butt joint held together by an adhesive backed strip.

7. The protective cover package of claim 5 wherein the first and second marginal edges of the closed loop sheet member are joined via a joining technique, and wherein the endless photoreceptor belt is loaded onto the support rollers of the image forming apparatus by inserting the closed loop sheet member, with the belt supported therein over the support rollers.

8. The protective cover package of claim 7 wherein the first marginal edge of the sheet member includes a flap to permit sheet member removal means, of the image forming apparatus, to grasp the flap and cause separation of the first and second marginal edges of the sheet member along the joining technique, so that the closed loop sheet member can be removed from around the belt and the support rollers, leaving only the belt on the support rollers of the image forming apparatus.

9. The protective cover package of claim 1 wherein the flexibity of the sheet member allows the sheet member, with the endless belt supported therein, to also assume a compact configuration in addition to the belt loading configuration, the compact configuration requiring less volume than the belt loading configuration, and the compact configuration facilitating storage and shipping of the endless belt.

10. The protective cover package of claim 9 wherein one of the compact configuration and the belt loading configuration is a normal state of the sheet member and the other one of the compact configuration and belt loading configuration is facilitated by an outer force.

11. The protective cover package of claim 10 wherein the normal state of the closed loop sheet member is the compact configuration wherein the outer force that facilitates the belt loading configuration is provided by a user.

12. The protective cover package of claim 1 wherein the endless belt is loaded onto the support roller of the image forming apparatus by inserting the closed loop sheet member, with the belt supported therein, over the support rollers, and wherein the width of the sheet member is less than a width of the endless photoreceptor belt so as to permit a photoreceptor belt hold down mechanism, of the images forming apparatus, to hold the belt against movement relative to the support rollers, so that the sheet member can be removed from the support roller and the belt, leaving only the belt on the support rollers of the image forming apparatus.

13. The protective cover package of claim 12, further including stop tabs on a side edge of the closed loop sheet member that keep the endless belt from moving relative to the sheet member when the sheet member, with the belt supported therein, is inserted over the support rollers.

14. The protective cover package of claim 13, further including a grip mechanism on the sheet member to allow a user to grip the sheet member to facilitate the removal of the closed loop sheet member from around the endless belt and the support rollers.

15. The protective cover package of claim 14 wherein the grip mechanism includes a pair of oppositely positioned handles that extend outwardly from a side edge of the closed loop sheet member.

16. The protective cover package of claim 1 further comprising indicia visibly positioned on the sheet member.

17. A protective cover package for an endless, photoreceptor coated belt of an image forming apparatus, the cover package comprising:

an endless belt having an outer surface coated with a photoreceptor; and a protective, removable ink coating covering the photoreceptor coated outer surface of the endless belt, wherein the ink coating protects the photoreceptor coated outer surface of the endless belt from damage that would adversely affect image reproduction quality of the photoreceptor coated outer surface, and wherein the ink coating is readily removed from the outer photoreceptor coated surface of the endless belt by cycling the endless belt through an image forming cycle of the image forming apparatus.

18. A protective cover package for an endless, photoreceptor coated belt of an image forming apparatus, the cover package comprising:

an endless belt having an outer surface coated with a photoreceptor;

a protective, removable wax coating covering the photoreceptor coated outer surface of the endless belt, wherein the wax coating protects the photoreceptor coated outer surface of the endless belt from damage that would adversely affect image reproduction quality of the photoreceptor coated outer surface; and wherein the wax coating is readily removed from the outer photoreceptor coated surface of the endless belt by heating the endless belt for a period of time.

19. A method of loading an endless photoreceptor belt onto support rollers of an image forming apparatus, the method comprising the steps of:

providing a closed loop, sheet member extending about an outer surface of the endless photoreceptor belt, an inner surface of the sheet member having an article which releasably secures the outer surface of the endless photoreceptor belt to the inner surface of the sheet member, the sheet member, with the endless photoreceptor belt supported therein, having a configuration that substantially duplicates a configuration of support rollers of the image forming apparatus;

aligning the sheet member with the support rollers of the image forming apparatus such that the configuration of the sheet member matches the configuration of the support rollers;

moving the closed loop sheet member onto the support rollers such that the sheet member, with the endless photoreceptor belt supported therein, is fully on the support rollers;

removing the closed loop sheet member from around the endless photoreceptor belt and the support rollers leaving only the endless photoreceptor belt on the support rollers of the image forming apparatus; and tensioning the endless photoreceptor belt to make the belt ready for image reproduction.

20. The method of claim 19 wherein the step of removing the closed loop sheet member from around the endless photoreceptor belt and the support rollers includes the steps of:

holding the belt against movement relative to the support rollers using a photoreceptor belt hold down mechanism of the image forming apparatus, so that the sheet member can be removed from the belt without altering the position of the belt; and grasping a grip mechanism on the sheet member to facilitate removal of the sheet member from around the belt and the support rollers.

21. A method of loading an endless photoreceptor belt onto support rollers of an image forming apparatus, the method comprising the steps of:

providing a closed loop sheet member extending about an outer surface of the endless photoreceptor belt, an inner surface of the sheet member having a mechanism which releasably secures the outer surface of the endless photoreceptor belt to the inner surface of the sheet member, the sheet member, with the endless photoreceptor belt supported therein, having a configuration that substantially duplicates a configuration of support rollers of the image forming apparatus;

aligning the sheet member with the support rollers of the image forming apparatus such that the configuration of the sheet member matches the configuration of the support rollers;

moving the closed loop sheet member onto the support rollers such that the sheet member, with the endless photoreceptor belt supported therein, is fully on the support rollers;

actuating a sheet member removal mechanism of the image forming apparatus which is engaged with a removal flap on the closed loop sheet member and causes the sheet member to separate along its marginal edges and removes the sheet member from around the endless photoreceptor belt and the support rollers without altering the position of the belt, leaving only the endless photoreceptor belt on the support rollers of the image forming apparatus;

removing the closed loop sheet member from the sheet member removal mechanism; and tensioning the endless photoreceptor belt to make the belt ready for image reproduction.

* * * * *